US011261878B2

(12) United States Patent
Ishikawa et al.

(10) Patent No.: US 11,261,878 B2
(45) Date of Patent: Mar. 1, 2022

(54) VANED DIFFUSER AND CENTRIFUGAL COMPRESSOR

(71) Applicant: MITSUBISHI HEAVY INDUSTRIES, LTD., Tokyo (JP)

(72) Inventors: Yoshihiro Ishikawa, Tokyo (JP); Isao Tomita, Tokyo (JP); Kenichiro Iwakiri, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/780,094

(22) Filed: Feb. 3, 2020

(65) Prior Publication Data

US 2021/0054850 A1 Feb. 25, 2021

(30) Foreign Application Priority Data

Aug. 22, 2019 (JP) ..... JP2019-151896

(51) Int. Cl.
*F04D 29/44* (2006.01)
*F04D 17/10* (2006.01)

(52) U.S. Cl.
CPC ..... *F04D 29/444* (2013.01); *F04D 17/10* (2013.01)

(58) Field of Classification Search
CPC ..... F04D 29/444; F04D 17/10
See application file for complete search history.

(56) References Cited

U.S. PATENT DOCUMENTS 3,719,430 A 3/1973 Blair et al.
3,860,360 A * 1/1975 Yu ..... F04D 29/441 415/208.3

(Continued)

FOREIGN PATENT DOCUMENTS

CN 109790853 5/2019
EP 1 860 325 11/2007

(Continued)

OTHER PUBLICATIONS

Office Action dated Dec. 22, 2021 in corresponding Chinese Application No. 202010088104.8, with Machine Translation, 12 pages.

*Primary Examiner* — Courtney D Heinle
*Assistant Examiner* — Michael K. Reitz
(74) *Attorney, Agent, or Firm* — Wenderoth, Lind & Ponack, L.L.P.

(57) ABSTRACT

A vaned diffuser provided on a downstream side of an impeller of a centrifugal compressor. The vaned diffuser includes: a diffuser passage forming portion having a hub-side surface and a shroud-side surface and forming an annular diffuser passage on a downstream side of the impeller; and a plurality of diffuser vanes provided in the diffuser passage at intervals in a circumferential direction of the impeller. A fillet is formed in a connection portion between each of the diffuser vanes and at least one of the hub-side surface and the shroud-side surface. Also, where R is a radius of the fillet and b is a vane height of each of the diffuser vanes, and a maximum value of R/b on a downstream side of a throat position of the diffuser passage is larger than a maximum value of R/b on an upstream side of the throat position of the diffuser passage.

7 Claims, 9 Drawing Sheets

(56) References Cited

U.S. PATENT DOCUMENTS

| | | | | |
|---|---|---|---|---|
| 3,930,746 | A * | 1/1976 | Kronogard | F04D 17/127 415/149.1 |
| 3,963,369 | A * | 6/1976 | Balje | F04D 29/462 415/148 |
| 9,551,225 | B2 | 1/2017 | Japikse | |
| 2005/0163610 | A1* | 7/2005 | Higashimori | F04D 29/444 415/191 |
| 2007/0274826 | A1 | 11/2007 | Kuhnel et al. | |
| 2017/0342847 | A1* | 11/2017 | Mazur | F02C 7/04 |
| 2018/0216629 | A1 | 8/2018 | Benetschik et al. | |
| 2019/0264705 | A1 | 8/2019 | Higashimori et al. | |

FOREIGN PATENT DOCUMENTS

| | | |
|---|---|---|
| JP | 09-100799 | 4/1997 |
| JP | 2004-092482 | 3/2004 |
| JP | 2009-197613 | 9/2009 |
| JP | 2018-80653 | 5/2018 |
| JP | 2018-119549 | 8/2018 |

* cited by examiner

VANED DIFFUSER AND CENTRIFUGAL COMPRESSOR

TECHNICAL FIELD

The present disclosure relates to a vaned diffuser and a centrifugal compressor.

BACKGROUND

A centrifugal compressor used in a compressor unit of a turbo charger for vehicles, vessels, and industrial machines adds kinetic energy to fluid through rotation of vaned wheels and discharges fluid toward the outer side in a radial direction to achieve a pressure rise based on a centrifugal force.

Various efforts have been made to improve performance of a centrifugal compressor. One of the efforts is improvement of static pressure recovery performance (diffuser performance) of a vaned diffuser provided on a downstream side of an impeller of the centrifugal compressor. For example, Patent Document 1 discloses a technique for suppressing decrease in diffuser performance by decreasing an incidence between a vane angle of a diffuser vane and a flow angle of fluid (see Patent Document 1).

CITATION LIST

Patent Literature

Patent Document 1: JP2004-92482A

SUMMARY

In the centrifugal compressor disclosed in Patent Document 1 suppress decrease in diffuser performance more effectively by taking a distribution in a vane height direction of the incidence into consideration. However, further improvement in the diffuser performance is required from the perspective of improvement in the performance of the centrifugal compressor.

With the foregoing in view, an object of at least one embodiment of the present invention is to improve the diffuser performance of a vaned diffuser.

(1) A vaned diffuser according to at lease one embodiment of the present invention is a vaned diffuser provided on a downstream side of an impeller of a centrifugal compressor, including: a diffuser passage forming portion that includes a hub-side surface and a shroud-side surface facing the hub-side surface and forms an annular diffuser passage on a downstream side of the impeller; and a plurality of diffuser vanes provided in the diffuser passage at intervals in a circumferential direction of the impeller, wherein a fillet is formed in a connection portion between each of the plurality of diffuser vanes and at least one of the hub-side surface and the shroud-side surface, and wherein R is a radius of the fillet and b is a vane height of each of the plurality of diffuser vanes, and a maximum value of R/b on a downstream side of a throat position of the diffuser passage is larger than a maximum value of R/b on an upstream side of the throat position of the diffuser passage.

In general, a diffuser passage is formed so that a passage cross-sectional area increases toward the downstream side so that the velocity of flow of fluid decreases toward the downstream side in order to achieve static pressure recovery. Moreover, since the fluid near the connection portion is likely to be influenced from each of the hub-side surface and the diffuser vane which are two crossing walls or from each of the shroud-side surface and the diffuser vane, the velocity of flow of fluid is particularly likely to decrease. In the diffuser passage, although the static pressure on the downstream side of the diffuser passage increases due to a static pressure rise resulting from the static pressure recovery, when the velocity of flow of fluid near the connection portion decreases, a backflow of fluid may occur due to the influence of the static pressure which increases toward the downstream side of the diffuser passage. Therefore, the flow of fluid may be separated from the connection portion, the effective passage cross-sectional area may be narrowed, and the static pressure recovery performance may decrease.

Here, since the radius R of the fillet formed in the connection portion increases when R/b is increased, the hub-side surface and the shroud-side surface in the connection portion are smoothly connected to the diffuser vane with the fillet disposed therebetween, the fluid is less likely to be influenced from the two crossing walls, and the decrease in the velocity of flow of fluid near the connection portion is suppressed. Therefore, it is possible to suppress occurrence of the backflow described above and to suppress separation of the fluid. Moreover, since the passage cross-sectional area decreases when R/b is increased as compared to the small R/b, it is possible to suppress the velocity of flow of fluid from decreasing more than necessary, the backflow described above is less likely to occur, and separation of the fluid can be suppressed. From the perspective of the static pressure recovery, although it is desirable to further increase the passage cross-sectional area of the diffuser passage toward the downstream side to further decrease the velocity of flow of fluid, if the velocity of flow of fluid decreases excessively the above-described backflow and separation occurs, the diffuser performance decreases greatly. Therefore, by increasing R/b, it is possible to increase the amount of increase in the passage cross-sectional area increasing toward the downstream side and suppress the backflow and the separation, which leads to improvement in the diffuser performance.

On the other hand, it is desirable to increase the passage cross-sectional area as much as possible on a side closer to the upstream side than the throat position of the diffuser passage in order to achieve improvement in the diffuser performance. Therefore, the smaller R/b is desirable on the side closer to the upstream side than the throat position of the diffuser passage.

According to the configuration of (1), the maximum value of R/b on the downstream side of the throat position of the diffuser passage is larger than the maximum value of R/b on the upstream side of the throat position of the diffuser passage. Therefore, since the passage cross-sectional area on the side closer to the upstream side than the throat position of the diffuser passage can be increased as much as possible while suppressing the backflow and separation described above, it is possible to improve the diffuser performance effectively.

(2) In some embodiments, in the configuration of (1), the maximum value of R/b on the downstream side of the throat position of the diffuser passage is equal to or more than 0.2.

According to the findings of the present inventor, the thickness of a boundary layer of the diffuser passage (that is, the thickness of a region near the wall where the velocity of flow of fluid is relatively low) is approximately 20% of the vane height of the diffuser vane. Therefore, according to the configuration of (2), when the maximum value of R/b is equal to or more than 0.2, since the dimension in the vane height direction of the fillet is 20% or more of the vane height of the diffuser vane, decrease in the velocity of flow of fluid near the connection portion is suppressed effectively. Therefore, it is possible to suppress the backflow and separation effectively.

(3) In some embodiments, in the configuration of (1) or (2), R/b in at least a partial segment on the downstream side of the throat position of the diffuser passage increases toward a trailing edge side of the diffuser vane.

According to the findings of the present inventor, the backflow and separation described above develops toward the downstream side of the diffuser passage. Therefore, according to the configuration of (3), by increasing R/b toward the trailing edge side of the diffuser vane, it is possible to suppress the backflow and separation described above effectively.

(4) In some embodiments, in the configuration of (3), R/b in at least a partial segment on the downstream side of the throat position of the diffuser passage increases linearly toward a trailing edge side of the diffuser vane.

According to the findings of the present inventor, better diffuser performance is obtained when the passage cross-sectional area of the diffuser passage changes linearly toward the trailing edge side of the diffuser vane as compare to when the passage cross-sectional area changes nonlinearly. Therefore, when the diffuser vane is formed in a linear form using a planar member or the like, for example, by increasing R/b linearly toward the trailing edge side of the diffuser vane as in the configuration of (4), it is possible to change the passage cross-sectional area of the diffuser passage linearly. In this way, satisfactory diffuser performance is obtained.

According to the configuration of (4), since the fillet is formed so that the radius R of the fillet changes linearly, it is easy to manufacture the vaned diffuser.

(5) In some embodiments, in the configuration of (3), R/b in at least a partial segment on the downstream side of the throat position of the diffuser passage increases curvedly toward a trailing edge side of the diffuser vane so that an amount of change increases toward the trailing edge side.

According to the findings of the present inventor, better diffuser performance is obtained when the passage cross-sectional area of the diffuser passage changes linearly toward the trailing edge side of the diffuser vane as compare to when the passage cross-sectional area changes nonlinearly. Therefore, when the diffuser vane is formed in a nonlinear curved form toward the trailing edge side, for example, by increasing R/b curvedly so that the amount of change increases (that is, the value of R/b becomes downwardly convex) toward the trailing edge side of the diffuser vane, it is possible to change the passage cross-sectional area of the diffuser passage linearly. In this way, satisfactory diffuser performance is obtained.

(6) In some embodiments, in the configuration of any one of (1) to (5), the fillet is formed on a pressure surface and a suction surface of each of the plurality of diffuser vanes, and when $R_P$ is a radius of the fillet formed on the pressure surface and $R_S$ is a radius of the fillet formed on the suction surface, a distribution of $R_P$/b of the fillet formed on the pressure surface is different from a distribution of $R_S$/b of the fillet formed on the suction surface.

According to the findings of the present inventor, the thickness on the pressure surface side of the boundary layer of the diffuser passage is different from that on the suction surface side. Therefore, as in the configuration of (6), when the distribution of $R_P$/b of the fillet formed in the pressure surface is different from the distribution of $R_S$/B of the fillet formed in the suction surface depending on the thicknesses of the boundary layers formed on the respective surfaces, it is possible to improve the diffuser performance.

(7) In some embodiments, in the configuration of (6), a maximum value of RP/b on the downstream side of the throat position of the diffuser passage is larger than a maximum value of RS/b on the downstream side of the throat position of the diffuser passage.

According to the findings of the present inventor, at a certain operating point of the centrifugal compressor, the boundary layer on the pressure surface side is thicker than that on the suction surface side. Therefore, as in the configuration of (7), when the maximum value of $R_P$/b on the pressure surface side on the downstream side of the throat position is larger than the maximum value of $R_S$/b on the suction surface side, since a secondary flow is created and the boundary layer on the pressure surface side becomes thin, it is possible to improve the diffuser performance.

(8) In some embodiments, in the configuration of any one of (1) to (7), the fillet is formed in only a connection portion between the hub-side surface and each of the plurality of diffuser vanes or in only a connection portion between the shroud-side surface and each of the plurality of diffuser vanes.

The fillet formed in only the connection portion between the hub-side surface and each of the plurality of diffuser vanes or in only the connection portion between the shroud-side surface and each of the plurality of diffuser vanes contributes to improvement in the diffuser performance. Therefore, according to the configuration of (8), it is possible to improve the diffuser performance.

(9) In some embodiments, in the configuration of any one of (1) to (7), the impeller includes a plurality of vanes provided at intervals in the circumferential direction of the impeller, tips of the plurality of vanes are arranged with a predetermined gap with respect to an inner surface of a casing of the centrifugal compressor, and the fillet is formed at least in a connection portion between the shroud-side surface and each of the plurality of diffuser vanes.

According to the configuration of (9), the tips of the plurality of vanes are arranged with a predetermined gap with respect to the inner surface of the casing of the centrifugal compressor. That is, according to the configuration of (9), the impeller is configured as a so-called open-type impeller that does not have an annular shroud member.

According to the findings of the present inventor, in a centrifugal compressor having an open-type impeller, a boundary layer which is thicker on the shroud-side surface than that on the hub-side surface is formed due to the influence of a leakage flow from the tip clearance of the vane.

Therefore, according to the configuration of (9), since the fillet is formed in the connection portion between the shroud-side surface and each of the plurality of diffuser vanes, it is possible to achieve improvement in the diffuser performance of an open-type impeller.

(10) A centrifugal compressor according to at least one embodiment of the present invention includes: an impeller; and the vaned diffuser according to the configuration of any one of (1) to (9).

According to the configuration of (10), since the centrifugal compressor includes the vaned diffuser of the configuration of any one of (1) to (9), it is possible to improve the diffuser performance effectively and to improve the efficiency of the centrifugal compressor.

According to at least one embodiment of the present invention, it is possible to improve the diffuser performance of a vaned diffuser.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not limitative of the scope of the present invention.

In the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For example, an expression of an equal state such as "same" "equal" and "uniform" shall not be construed as indicating only the state in which the feature is strictly equal, but also includes a state in which there is a tolerance or a difference that can still achieve the same function.

Furthermore, in the present specification, an expression of a shape such as a rectangular shape or a cylindrical shape shall not be construed as only the geometrically strict shape, but also includes a shape with unevenness or chamfered corners within the range in which the same effect can be achieved.

Furthermore, in the present specification, an expression such as "comprise," "include," "have," "contain" and "constitute" are not intended to be exclusive of other components.

Figure 1:
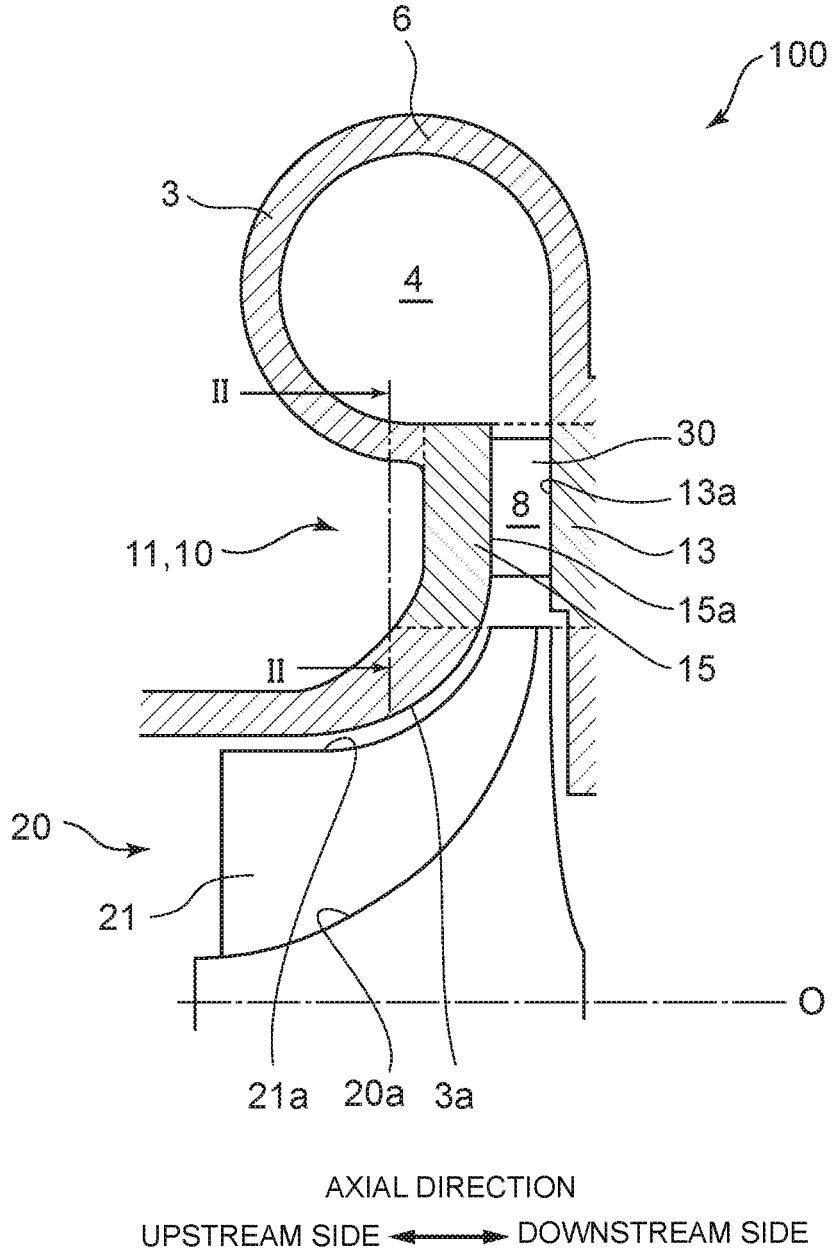
FIG. 1 is a schematic cross-sectional view along an axial direction of a centrifugal compressor according to an embodiment.
Figure 2:
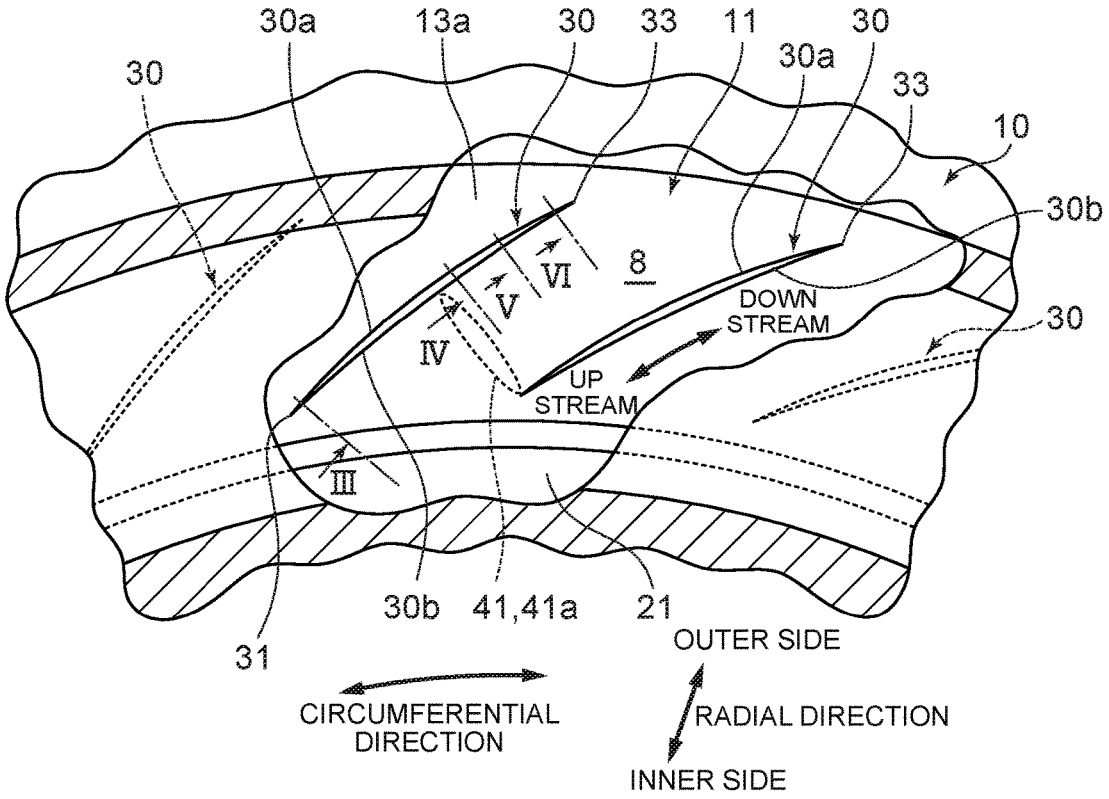
FIG. 2 is a view along arrow II-II in FIG. 1.
Figure 3:
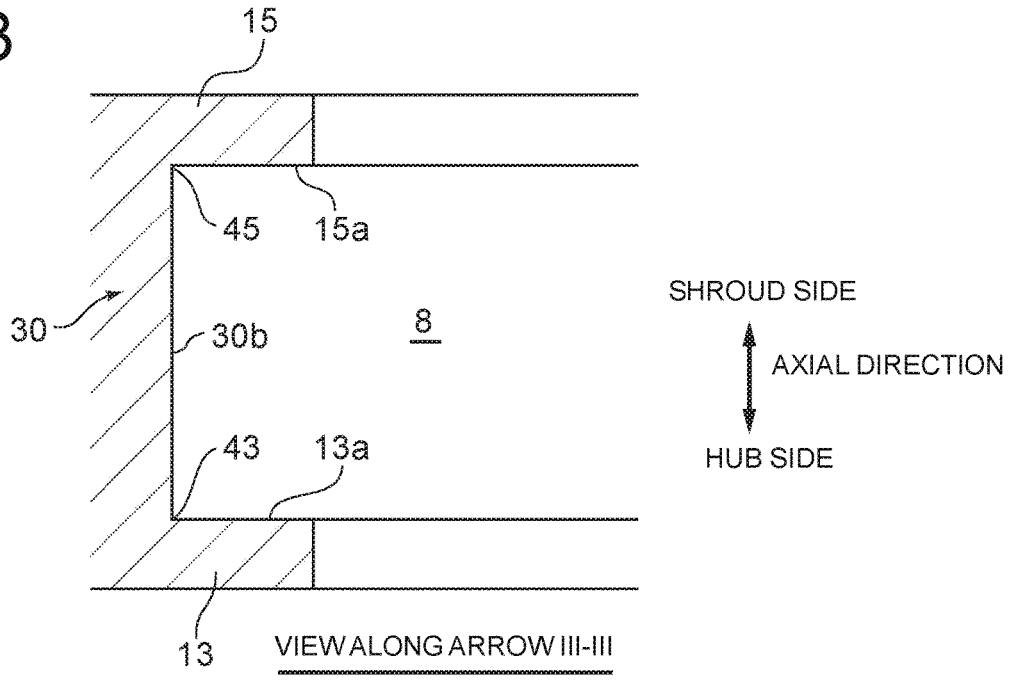
FIG. 3 is a view along arrow in FIG. 2.
Figure 4:
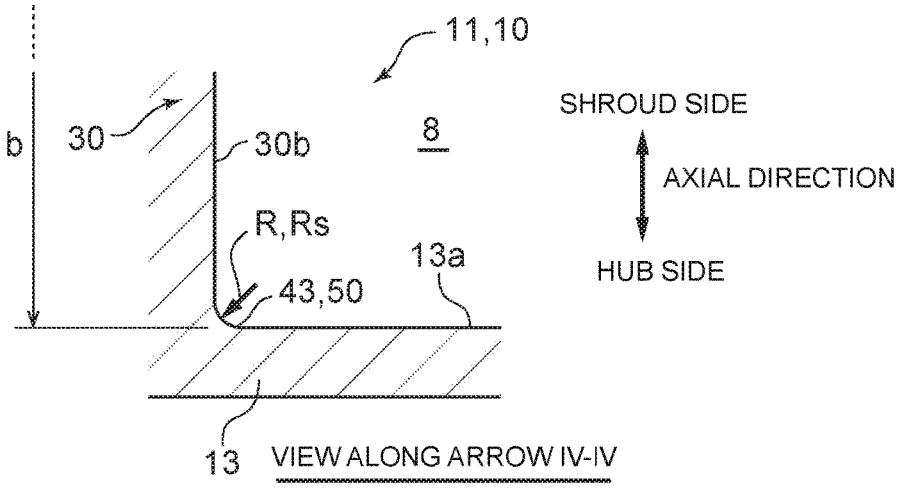
FIG. 4 is a view along arrow IV-IV in FIG. 2.
Figure 5:
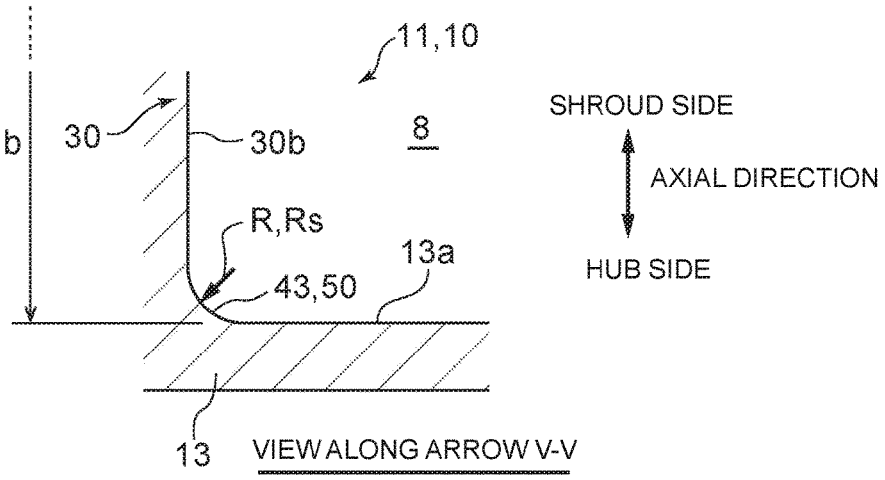
FIG. 5 is a view along arrow V-V in FIG. 2.
Figure 6:
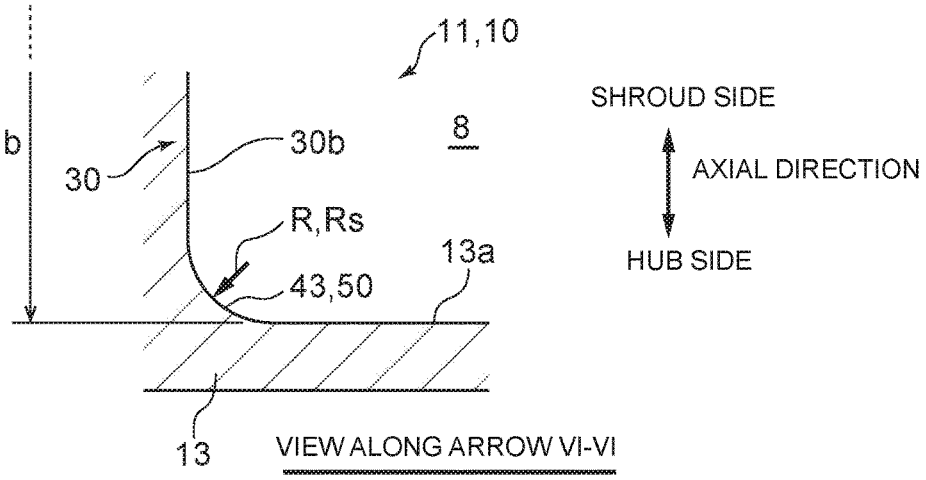
FIG. 6 is a view along arrow VI-VI in FIG. 2.

FIG. 1 is a schematic cross-sectional view along an axial direction of a centrifugal compressor 100 according to an embodiment. FIG. 2 is a perspective view along arrow II-II in FIG. 2 and is a schematic view for describing a vaned diffuser 10 to be described later. FIG. 3 is a view along arrow in FIG. 2. FIG. 4 is a view along arrow IV-IV in FIG. 2. FIG. 5 is a view along arrow V-V in FIG. 2. FIG. 6 is a view along arrow VI-VI in FIG. 2.

The centrifugal compressor 100 can be applied to, for example, turbo chargers for automobiles or vessels, and other industrial centrifugal compressors, blowers, and the like.

In the following description, an axial direction (that is, an extension direction of the center of rotation O) of an impeller 20 to be described later will be referred to as an axial direction. The upstream side along the flow of fluid flowing into the centrifugal compressor 100 among the axial directions will be referred to as an axial upstream side, and the opposite side will be referred to as an axial downstream side. In FIGS. 3 to 9 to be described later, the axial upstream side will be referred to as a shroud side and the axial downstream side will be referred to as a hub side.

In the following description, a radial direction of the impeller 20 about the center of rotation O will be also referred to simply a radial direction. A direction closer to the center of rotation O among the radial directions is referred to as a radial inner side, and a direction away from the center of rotation O will be referred to as a radial outer side.

In the following description, a direction along the rotation direction of the impeller 20 about the center of rotation O will be also referred to simply as a circumferential direction.

In the following description, a side simply referred to as the upstream side indicates an upstream side along the direction of a major flow of fluid in a portion or a region related to the description of a direction. Similarly, in the following description, a side simply referred to as the downstream side indicates a downstream side along the direction of a major flow of fluid in a portion or a region related to the description of a direction.

The centrifugal compressor 100 according to some embodiments includes an impeller 20 and a casing 3 as illustrated in FIG. 1, for example. The casing 3 includes a scroll portion 6 that forms a scroll passage 4 on an outer circumference portion of the impeller 20 and a vaned diffuser 10 provided on the downstream side of the impeller 20 to supply fluid (compressed air) compressed by the impeller 20 to the scroll passage 4.

In some embodiments, the impeller 20 includes a plurality of vanes 21 provided at intervals in a circumferential direction of the impeller 20. Each of the plurality of vanes 21 stands on a hub surface 20*a* of the impeller 20.

In some embodiments, the tips 21*a* of the plurality of vanes 21 are arranged with a predetermined gap with respect to an inner surface 3*a* of the casing 3. That is, the impeller 20 according to some embodiments is configured as an open-type impeller that does not include an annular shroud member.

The vaned diffuser 10 according to some embodiments includes a diffuser passage forming portion 11 that forms an annular diffuser passage 8 on the downstream side of the impeller 20 and a plurality of diffuser vanes 30 provided in the diffuser passage 8 at intervals in the circumferential direction of the impeller 20.

In a cross-section along the axial direction of the impeller 20 (that is, on the sheet surface of FIG. 1), the scroll passage 4 has a circular shape and the diffuser passage 8 is formed in a linear form.

The diffuser passage forming portion 11 is formed by a pair of passage walls 13 and 15 provided to sandwich the diffuser passage 8 in the axial direction of the impeller 20. Among the pair of passage walls 13 and 15, the hub-side passage wall 13 has a hub-side surface 13*a* contacting the diffuser passage 8, and the shroud-side passage wall 15 facing the hub-side surface 13*a* and the shroud-side surface 15*a* has contacting the diffuser passage 8.

In FIG. 1, although the scroll portion 6 and the diffuser passage forming portion 11 are hatched with different patterns for the sake of convenience, the casing 3 may be formed of a plurality of casing components connected at arbitrary positions regardless of the boundary position between the scroll portion 6 and the diffuser passage forming portion 11. Moreover, the casing 3 may include a part of a bearing housing that accommodates bearings that rotatably support the impeller 20 in addition to a compressor housing that accommodates the impeller 20.

For example, as well illustrated in FIG. 2, each of the plurality of diffuser vanes 30 has a pressure surface-side wall 30*a* extending from a leading edge 31 which is an inner end in the radial direction of the diffuser vane 30 to a trailing edge 33 which is an outer end in the radial direction and a suction surface-side wall 30*b* provided on the opposite side in a vane thickness direction from the pressure surface-side wall 30*a*. In the following description, the pressure surface-side wall 30*a* will be also referred to simply as a pressure surface 30*a*, and the suction surface-side wall 30*b* will be also referred to simply as a suction surface 30*b*. In some embodiments, a convex-side wall of the diffuser vane 30 is the pressure surface 30*a* and a concave-side wall is the suction surface 30*b*.

In a pair of diffuser vanes 30 adjacent in the circumferential direction, the pressure surface 30*a* of one diffuser vane 30 faces the suction surface 30*b* of the other diffuser vane 30. A position at which the passage area between a pair of diffuser vanes 30 is the smallest is referred to as a throat 41. In FIG. 2, a region where the throat 41 is present is indicated by broken lines. In the following description, the position of the region where the throat 41 is present will be also referred to as a throat position 41*a*.

In the centrifugal compressor 100 according to some embodiments, the diffuser performance of the vaned diffuser 10 is improved in order to improve the performance of the centrifugal compressor 100. Hereinafter, the vaned diffuser 10 according to some embodiments will be described in detail.

The vaned diffuser 10 according to some embodiments includes a connection portion 43 between the hub-side surface 13*a* and each of the plurality of diffuser vanes 30 and a connection portion 45 between the shroud-side surface 15*a* and each of the plurality of diffuser vanes 30. That is, the vaned diffuser 10 according to some embodiments includes four connection portions 43 and 45 including the connection portion 43 connecting the pressure surface 30*a* and the hub-side surface 13*a*, the connection portion 43 connecting the suction surface 30*b* and the hub-side surface 13*a*, the connection portion 45 connecting the pressure surface 30*a* and the shroud-side surface 15*a*, and the connection portion 45 connecting the suction surface 30*b* and the shroud-side surface 15*a*.

In the vaned diffuser 10 according to some embodiments, as illustrated in FIGS. 4 to 6, a fillet 50 is formed in at least one connection portion of the four connection portions 43 and 45. In the example illustrated in FIGS. 4 to 6, the fillet 50 is formed in the connection portion 43 connecting the suction surface 30*b* and the hub-side surface 13*a*.

The fillet 50 according to some embodiments is an arc formed intentionally unlike an arc of a corner also referred to a so-called corner R portion (that is, an arc of a corner formed unintentionally in the process of forming the vaned diffuser 10 in a crossing portion of walls). The radius of the fillet 50 has a radius of curvature larger than the radius of an arc of a corner formed unintentionally. In some embodiments, when the radius of an arc of a corner formed unintentionally is Ra, Ra/b generally has a size of approximately 0.05 to 0.1. The fillet 50 may not have a completely arc shape but may have an approximately arc shape.

The fillet 50 according to some embodiments may be formed in any one of three connection portions 43 and 45 other than the connection portion 43 connecting the suction surface 30*b* and the hub-side surface 13*a*.

Figure 7:
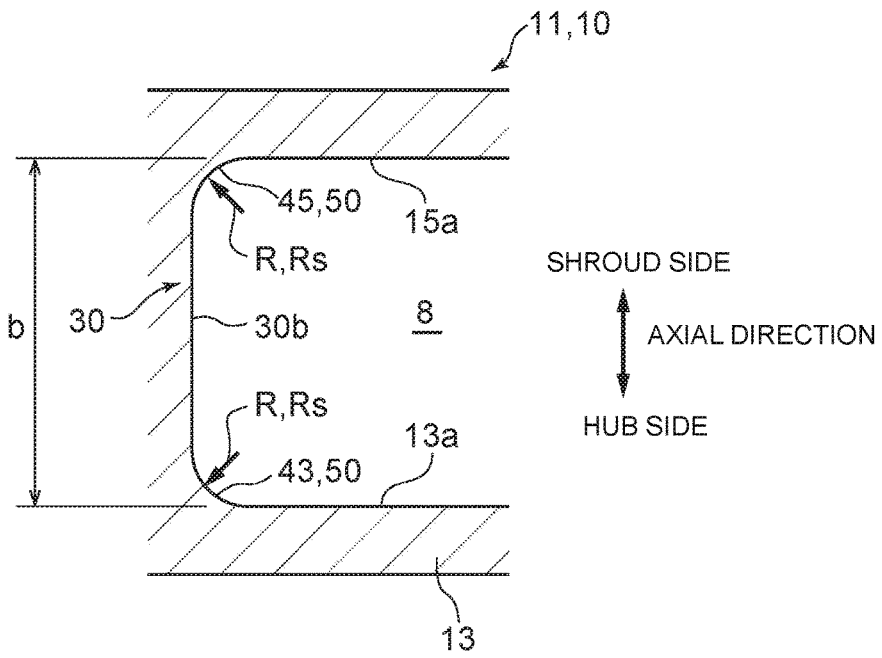
FIG. 7 is a schematic view illustrating an example in which a fillet is formed in two of four connection portions.

Moreover, the fillet 50 according to some embodiments may be formed in any two of the four connection portions 43 and 45. For example, FIG. 7 is a schematic view illustrating an example in which the fillet 50 is formed in two of the four connection portions 43 and 45. In the example illustrated in FIG. 7, the fillet 50 according to some embodiments is formed in the connection portion 43 connecting the suction surface 30*b* and the hub-side surface 13*a* and the connection portion 45 connecting the suction surface 30*b* and the shroud-side surface 15*a*.

Figure 8:
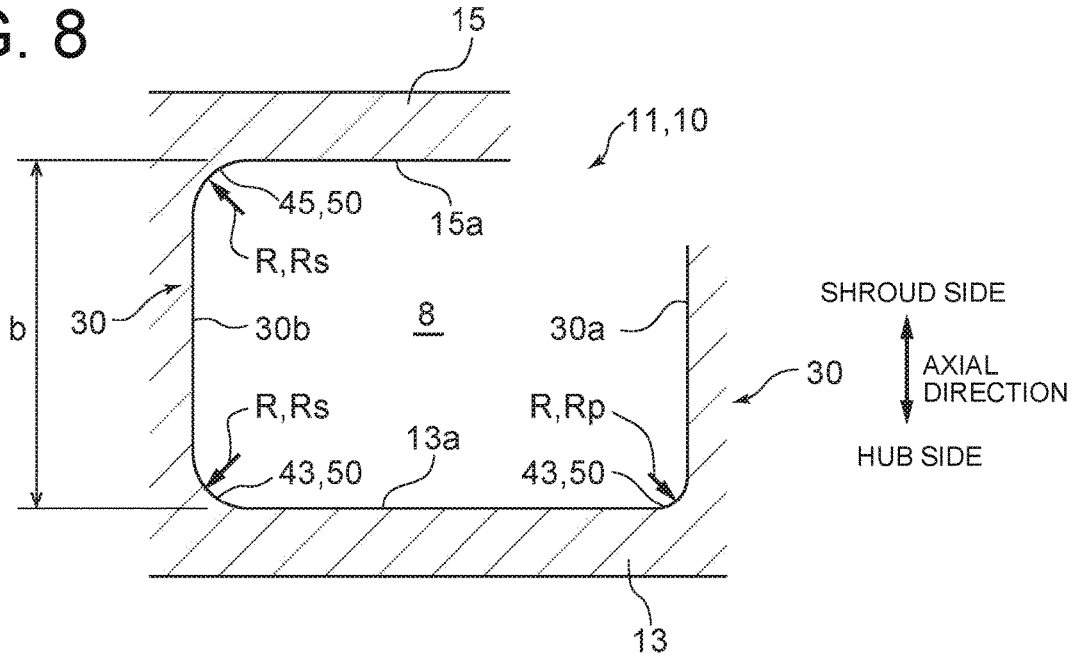
FIG. 8 is a schematic view illustrating an example in which a fillet is formed in three of four connection portions.

The fillet 50 according to some embodiments may be formed in any three of the four connection portions 43 and 45. For example, FIG. 8 is a schematic view illustrating an example in which the fillet 50 is formed in three of the four connection portions 43 and 45. In the example illustrated in FIG. 8, the fillet 50 according to some embodiments is formed in the connection portion 43 connecting the suction surface 30*b* and the hub-side surface 13*a*, the connection portion 45 connecting the suction surface 30*b* and the shroud-side surface 15*a*, and the connection portion 43 connecting the pressure surface 30*a* and the hub-side surface 13*a*.

Figure 9:
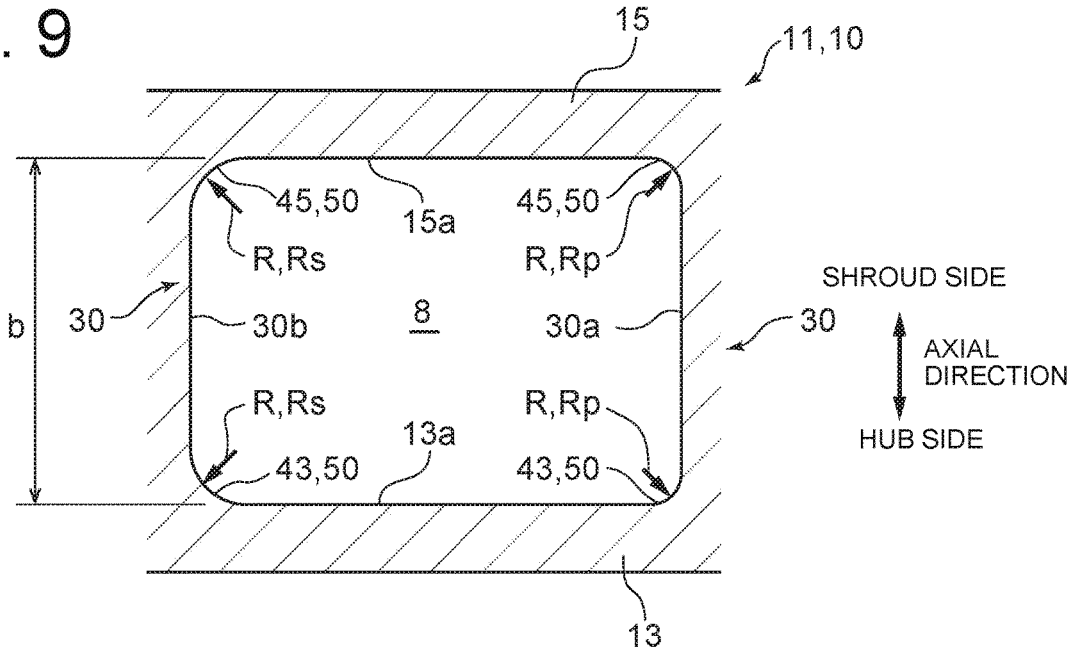
FIG. 9 is a schematic view illustrating an example in which a fillet is formed in all of four connection portions.

The fillet 50 according to some embodiments may be formed in all of the four connection portions 43 and 45. For example, FIG. 9 is a schematic view illustrating an example in which the fillet 50 is formed in all of the four connection portions 43 and 45.

FIGS. 10 to 13 are examples of a graph illustrating how the size of the radius R of the fillet 50 changes in a region ranging from the leading edge 31 of the diffuser vane 30 to the trailing edge 33 in some embodiments. In FIGS. 10 to 13, the position from the leading edge 31 to the trailing edge 33 of the concave-side wall 30*b* (that is, the suction surface 30*b*) is on the horizontal axis, and the value of R/b which is a division of the radius R of the fillet 50 by the vane height b of the diffuser vane 30 is on the vertical axis.

Graphs 71 to 74 in FIGS. 10 to 13 are simple examples and the present invention is not limited thereto.

For example, as illustrated in the graphs 71 and 74 in FIGS. 10 and 13, respectively, the fillet 50 may not be provided in a region ranging from the leading edge 31 to the throat position 41*a*, but the fillet 50 may be provided in a subsequent region later than the throat position 41*a* so that the value of R/b on a side closer to the trailing edge 33 than the throat position 41*a* is equal to or more than 0.2. In the following description, a subsequent region indicates a region ranging between a reference position and a position closer to the trailing edge 33 than the position. For example, the subsequent region later than the throat position 41*a* indicates a region ranging from the throat position 41*a* to a position closer to the trailing edge 33 than the throat position 41*a*.

For example, as illustrated in the graph 72 in FIG. 11, the fillet 50 may not be provided in a region ranging from the leading edge 31 to a position C2 closer to the leading edge 31 than the throat position 41*a*, but the fillet 50 may be provided in a subsequent region later than the position C2 so that the value of R/b at the throat position 41*a* is equal to or more than 0.2.

For example, as illustrated in the graph 73 in FIG. 12, the fillet 50 may not be provided in a region ranging from the leading edge 31 to a position C3 closer to the trailing edge 33 than the throat position 41*a*, but the fillet 50 may be provided in a subsequent region later than the position C3 so that the value of R/b at a position closer to the trailing edge 33 than the position C3 is equal to or more than 0.2.

As in the graphs 71*a*, 72*a*, and 73*a* in FIGS. 10, 11, and 12, respectively, the value of R/b in a subsequent region later than the position C1 closer to the trailing edge 33 than the throat position 41*a* may be constant.

Moreover, as in the graphs 71*b*, 72*b*, and 73*b* in FIGS. 10, 11, and 12, respectively, the value of R/b in a subsequent region later than the position C1 closer to the trailing edge 33 than the throat position 41*a* may increase gradually.

Moreover, as in the graphs 71*c*, 72*c*, and 73*c* in FIGS. 10, 11, and 12, respectively, the value of R/b in a subsequent region later than the position C1 closer to the trailing edge 33 than the throat position 41*a* may decrease gradually.

Figure 10:
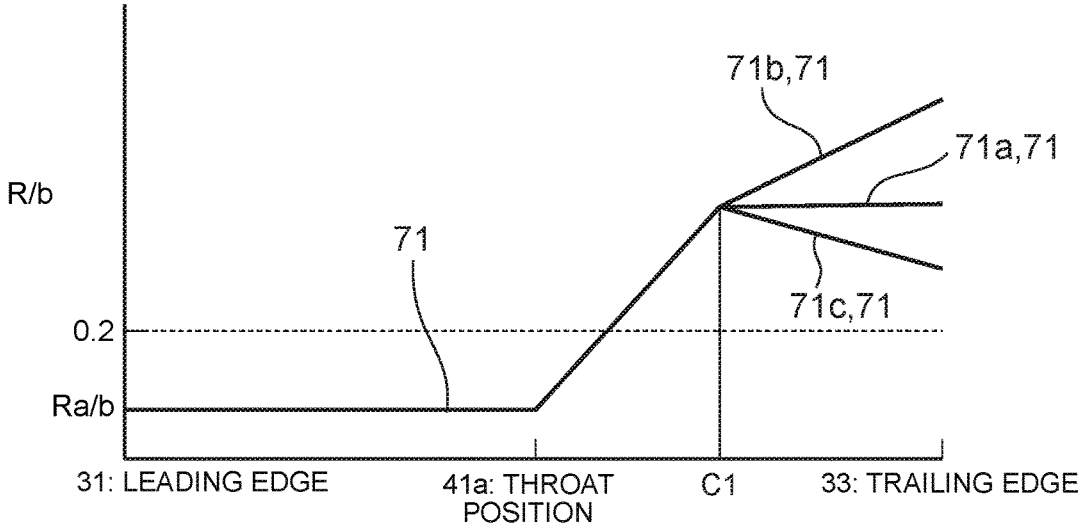
FIG. 10 is an example of a graph illustrating how the size of a radius R of the fillet changes in a region ranging from a leading edge of a diffuser vane to a trailing edge in some embodiments.
Figure 11:
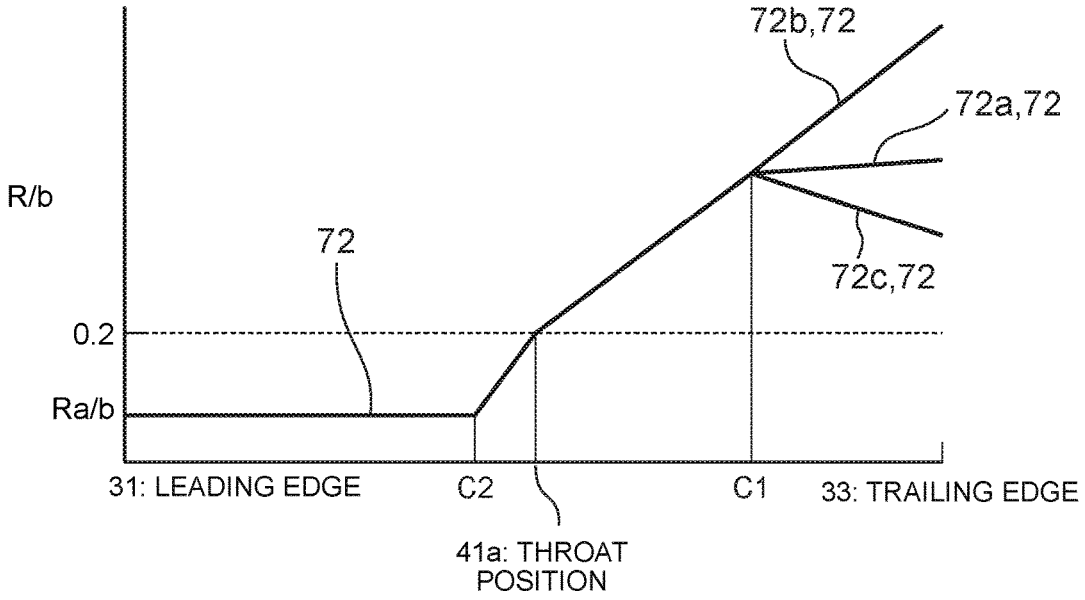
FIG. 11 is an example of a graph illustrating how the size of a radius R of the fillet changes in a region ranging from a leading edge of a diffuser vane to a trailing edge in some embodiments.
Figure 12:
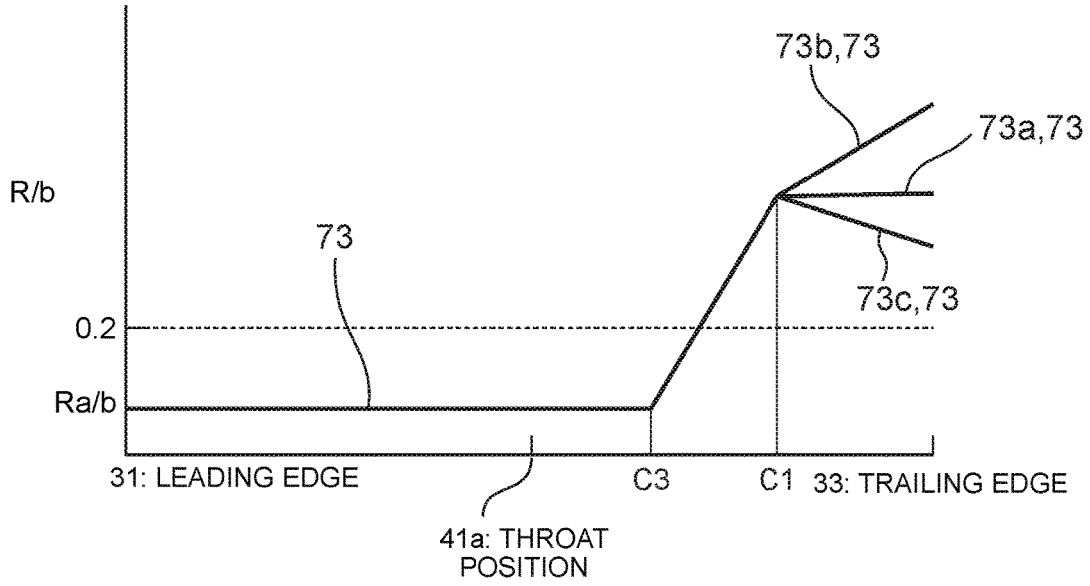
FIG. 12 is an example of a graph illustrating how the size of a radius R of the fillet changes in a region ranging from a leading edge of a diffuser vane to a trailing edge in some embodiments.
Figure 13:
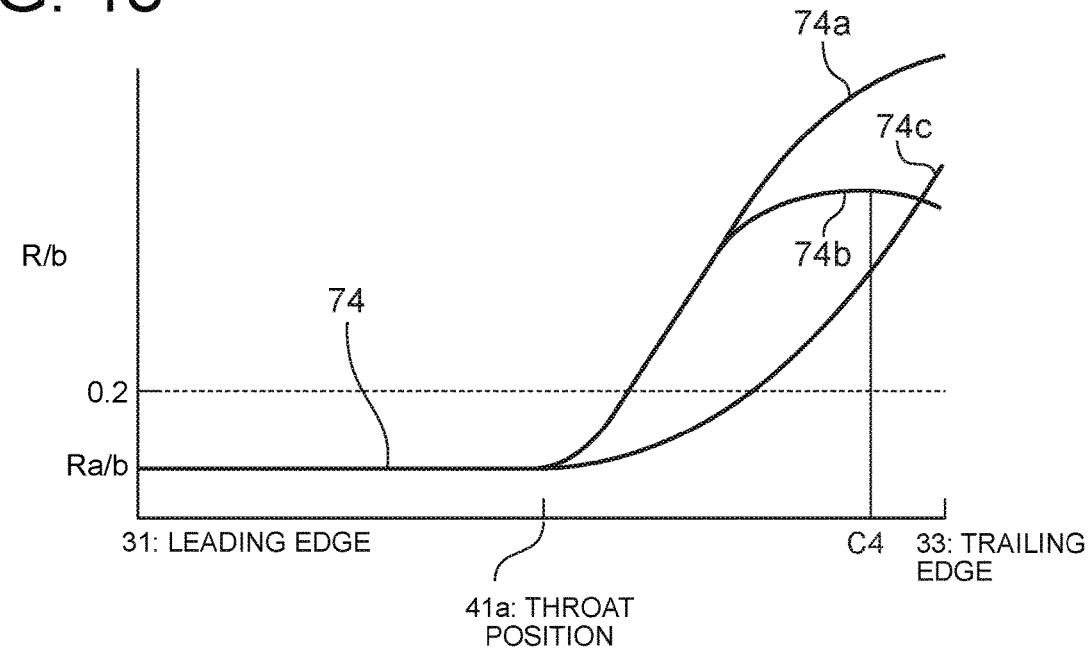
FIG. 13 is an example of a graph illustrating how the size of a radius R of the fillet changes in a region ranging from a leading edge of a diffuser vane to a trailing edge in some embodiments.

The value of R/b may be changed linearly as in the graphs 71 to 73 in FIGS. 10 to 12, respectively, and the value of R/b may be changed curvedly (nonlinearly) as in the graph 74 in FIG. 13.

Moreover, the value of R/b in a subsequent region later than the throat position 41*a* or at a position closer to the trailing edge 33 than the throat position 41*a* may increase gradually as in the graphs 74*a* and 74*c* in FIG. 13, and the value of R/b in a subsequent region later than the position C4 closer to the trailing edge 33 than the throat position 41*a* may decrease gradually as in the graph 74*b* in FIG. 13.

The amount of change in the value of R/b may decrease toward the trailing edge side as in the graph 74*a* in FIG. 13, and the amount of change in the value of R/b may increase toward the trailing edge side as in the graph 74*c* in FIG. 13.

Moreover, when the value of R/b decreases gradually toward the trailing edge 33 as in the graphs 71*c*, 72*c*, 73*c*, and 74*b* in FIGS. 10 to 13, respectively, the value of R/b in a partial segment in which the value of R/b decreases gradually may be smaller than 0.2.

In order to change the value of R/b, the vane thickness t of the diffuser vane 30 may be changed in an axial direction and the direction of flow of fluid. Here, the vane thickness t is the distance from a camber line of the diffuser vane 30 to a vane surface.

As illustrated in FIGS. 10 to 13, in the vaned diffuser 10 according to some embodiments, when R is the radius of the fillet 50 and b is a vane height of each of the plurality of diffuser vanes 30, the maximum value of R/b on the downstream side of the throat position 41*a* of the diffuser passage 8 is larger than the maximum value of R/b on the upstream side of the throat position 41*a* of the diffuser passage 8.

In general, the diffuser passage 8 is formed so that a passage cross-sectional area increases toward the downstream side so that the velocity of flow of fluid decreases toward the downstream side in order to achieve static pressure recovery. Moreover, since the fluid near the connection portion 43 or 45 is likely to be influenced from each of the hub-side surface 13*a* and the diffuser vane 30 which are two crossing walls or from each of the shroud-side surface 15*a* and the diffuser vane 30, the velocity of flow of fluid is particularly likely to decrease. In the diffuser passage 8, although the static pressure on the downstream side of the diffuser passage 8 increases due to a static pressure rise resulting from the static pressure recovery, when the velocity of flow of fluid near the connection portion 43 or 45 decreases, a backflow of fluid may occur due to the influence of the static pressure which increases toward the downstream side of the diffuser passage 8. Therefore, the flow of fluid may be separated from the connection portion 43 or 45, the effective passage cross-sectional area may be narrowed, and the static pressure recovery performance may decrease.

Here, since the radius R of the fillet 50 formed in the connection portion 43 or 45 increases when R/b is increased, the hub-side surface 13*a* and the shroud-side surface 15*a* in the connection portion 43 or 45 are smoothly connected to the diffuser vane 30 with the fillet 50 disposed therebetween, the fluid is less likely to be influenced from the two crossing walls, and the decrease in the velocity of flow of fluid near the connection portion 43 or 45 is suppressed. Therefore, it is possible to suppress occurrence of the backflow described above and to suppress separation of the fluid. Moreover, since the passage cross-sectional area decreases when R/b is increased as compared to the small R/b, it is possible to suppress the velocity of flow of fluid from decreasing more than necessary, the backflow described above is less likely to occur, and separation of the fluid can be suppressed. From the perspective of the static pressure recovery, although it is desirable to further increase the passage cross-sectional area of the diffuser passage 8 toward the downstream side to further decrease the velocity of flow of fluid, if the velocity of flow of fluid decreases excessively the above-described backflow and separation occurs, the diffuser performance decreases greatly. Therefore, by increasing R/b, it is possible to suppress the amount of increase in the passage cross-sectional area increasing toward the downstream side and suppress the backflow and the separation, which leads to improvement in the diffuser performance.

On the other hand, it is desirable to increase the passage cross-sectional area as much as possible on a side closer to the upstream side than the throat position 41*a* of the diffuser passage 8 in order to achieve improvement in the diffuser performance. Therefore, the smaller R/b is desirable on the side closer to the upstream side than the throat position 41*a* of the diffuser passage 8.

According to some embodiments, the maximum value of R/b on the downstream side of the throat position 41*a* of the diffuser passage 8 is larger than the maximum value of R/b on the upstream side of the throat position 41*a* of the diffuser passage 8. Therefore, since the passage cross-sectional area on the side closer to the upstream side than the throat position of the diffuser passage 8 can be increased as much as possible while suppressing the backflow and separation described above, it is possible to improve the diffuser performance effectively.

In the vaned diffuser 10 according to some embodiments, the fillet 50 may be formed in any one of the connection portion 43 between the hub-side surface 13*a* and each of the plurality of diffuser vanes 30 or in the connection portion 45 between the shroud-side surface 15*a* and each of the plurality of diffuser vanes 30.

Figure 14:
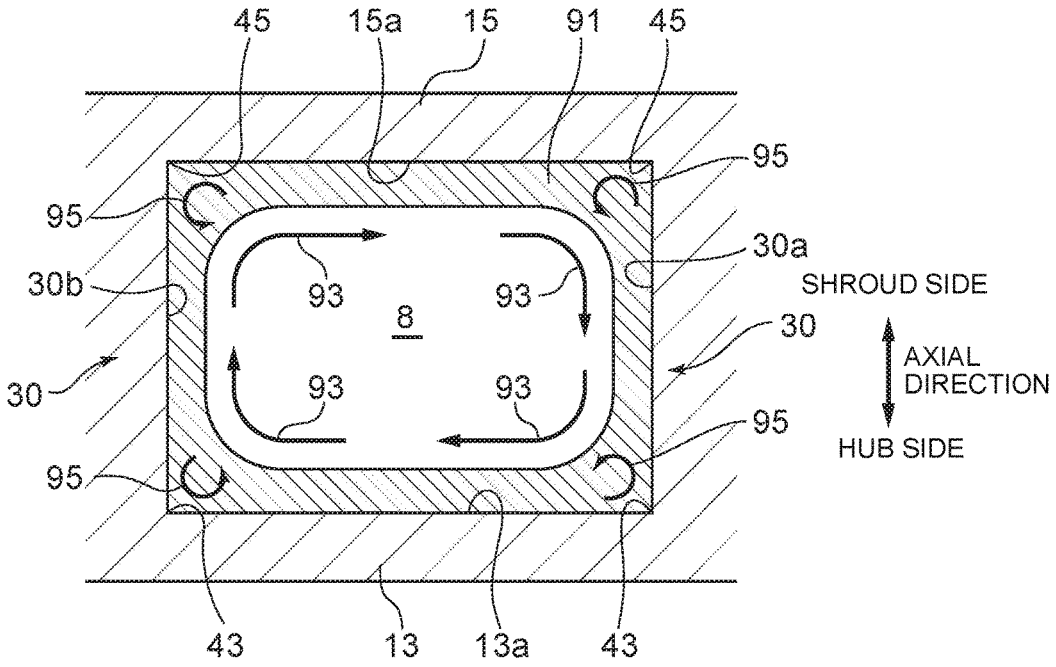
FIG. 14 is a diagram for describing a boundary layer and a secondary flow in a diffuser passage.

FIG. 14 is a diagram for describing a boundary layer and a secondary flow in the diffuser passage 8. FIG. 14 is a diagram corresponding to the view along arrow V-V in FIG. 2 and illustrates a case in which the fillet 50 is not formed.

Hereinafter, the influence on the diffuser performance of a boundary layer 91 and a secondary flow 93 will be described with reference to FIG. 14.

When fluid flows through the diffuser passage 8, since the fluid near the hub-side surface 13*a*, the shroud-side surface 15*a*, the pressure surface 30*a*, and the suction surface 30*b* which are walls is influenced by the walls, a boundary layer 91 occurs in which the velocity of flow decreases remarkably as compared to a region in which fluid is not influenced by these walls.

Moreover, in the diffuser passage 8, a pressure gradient occurs due to a difference between the pressure near the suction surface 30*b* and the pressure near the pressure surface 30*a*. This pressure gradient occurs in a cross-section parallel to a cross-section which is a plane including a direction orthogonal to the flowing direction of fluid in the diffuser passage 8 and a vane height direction (an axial direction) of the diffuser vane 30. FIGS. 3 to 9 and FIG. 14 illustrate a cross-section parallel to the cross-section.

The secondary flow 93 is the flow of fluid flowing so as to circulate inside the diffuser passage 8 along a direction parallel to an extension direction of the cross-section using the pressure gradient as a major driving force.

Another secondary flow 95 driven by the secondary flow 93 occurs near the connection portions 43 and 45. When this another secondary flow 95 occurs, a region called a corner stall in which fluid rarely flows in a direction from the upstream side of the diffuser passage 8 toward the downstream side occurs. The occurrence of the corner stall decreases an effective passage cross-section in the diffuser passage 8 and causes the backflow and separation described above, and therefore decreases the static pressure recovery performance.

Moreover, the velocity of major flow of the fluid decreases due to the static pressure recovery toward the downstream side of the diffuser passage 8. Therefore, in general, an occurrence region of the corner stall in the cross-section increases toward the downstream side of the diffuser passage 8.

In a portion of the diffuser passage 8 located closer to the upstream side than the throat position 41*a*, a state in which the kinetic energy of fluid flowing from the upstream side to the downstream side prevails is maintained. Therefore, the momentum (the momentum in a flow direction) of the fluid flowing from the upstream side to the downstream side is larger than the change in momentum resulting from the pressure gradient in the cross-section and the secondary flow 93 does not occur easily. Therefore, it is desirable to secure the passage cross-sectional area as large as possible on a side closer to the upstream side than the throat position 41*a*.

However, in a portion closer to the downstream side than the throat position 41*a*, the momentum in the flow direction decreases due to the static pressure recovery and the fluid starts being influenced by the pressure gradient in the cross-section.

In this case, by generating the secondary flow appropriately and making the thickness of the boundary layer 91 as thin as possible while maintaining such a momentum in a flow direction that overcomes the pressure gradient (reverse pressure gradient) of static pressure that increases toward the downstream side due to the static pressure recovery, it is possible to increase the effective passage cross-sectional area and to achieve a further static pressure recovery.

According to some embodiments, by changing the radius R of the fillet 50 in the extension direction of the diffuser passage 8, it is possible to control the secondary flow occurring due to the pressure gradient in the cross-section, extend the operating range of the centrifugal compressor 100, and improve the efficiency.

According to some embodiments, since the fillet 50 is formed in at least one of the four connection portions 43 and 45, a region in which a corner stall is likely to occur is replaced with the fillet 50 and occurrence of the corner stall can be suppressed.

As illustrated in FIGS. 10 to 13, in some embodiments, the maximum value of R/b on the downstream side of the throat position 41*a* of the diffuser passage 8 is equal to or more than 0.2.

According to the findings of the present inventor, the thickness of the boundary layer 91 of the diffuser passage 8 (that is, the thickness of a region near the wall where the velocity of flow of fluid is relatively low) is approximately 20% of the vane height b of the diffuser vane 30. Therefore, according to some embodiments, when the maximum value of R/b is equal to or more than 0.2, since the dimension in the vane height direction of the fillet 50 is equal to or more than 20% of the vane height b of the diffuser vane 30, decrease in the velocity of flow of fluid near the connection portion 43 or 45 is suppressed effectively. Therefore, it is possible to suppress the backflow and separation effectively.

As illustrated in FIGS. 10 to 13, in some embodiments, R/b in at least a partial segment on the downstream side of the throat position 41*a* of the diffuser passage 8 increases toward the trailing edge 33 of the diffuser vane 30.

According to the findings of the present inventor, the backflow and separation described above develops toward the downstream side of the diffuser passage 8. Therefore, according to some embodiments, by increasing R/b toward the trailing edge 33 of the diffuser vane 30, it is possible to suppress the backflow and separation described above effectively.

As illustrated in FIGS. 10 to 12, in some embodiments, R/b in at least a partial segment on the downstream side of the throat position 41*a* of the diffuser passage 8 increases linearly toward the trailing edge 33 of the diffuser vane 30.

According to the findings of the present inventor, better diffuser performance is obtained when the passage cross-sectional area of the diffuser passage 8 changes linearly toward the trailing edge 33 of the diffuser vane 30 as compare to when the passage cross-sectional area changes nonlinearly. Therefore, when the diffuser vane 30 is formed in a linear form using a planar member or the like, for example, by increasing R/b linearly toward the trailing edge 33 of the diffuser vane 30, it is possible to change the passage cross-sectional area of the diffuser passage 8 linearly. In this way, satisfactory diffuser performance is obtained.

Moreover, since the fillet 50 is formed so that the radius R of the fillet 50 changes linearly, it is easy to manufacture the vaned diffuser.

As in the graph 74*c* in FIG. 13, R/b in at least a partial segment on the downstream side of the throat position 41*a* of the diffuser passage 8 may increase curvedly toward the trailing edge 33 of the diffuser vane 30 so that the amount of change increases toward the trailing edge 33.

As described above, according to the findings of the present inventor, better diffuser performance is obtained when the passage cross-sectional area of the diffuser passage 8 changes linearly toward the trailing edge 33 of the diffuser vane 30 as compare to when the passage cross-sectional area changes nonlinearly. Therefore, when the diffuser vane 30 is formed in a nonlinear curved form toward the trailing edge 33, for example, by increasing the value of R/b curvedly so that the amount of change increases (that is, the value of R/b becomes downwardly convex as in the graph 74*c* in FIG. 13) toward the trailing edge 33 of the diffuser vane 30, it is possible to change the passage cross-sectional area of the diffuser passage 8 linearly. In this way, satisfactory diffuser performance is obtained.

When the fillet 50 is formed in each of the suction surface 30*b* and the pressure surface 30*a* of each of the plurality of diffuser vanes 30, the radius R of the fillet 50 may be adjusted as follows. That is, when $R_P$ is the radius of the fillet 50 formed on the pressure surface 30*a* and $R_S$ is the radius of the fillet 50 formed on the suction surface 30*b*, a distribution of $R_P$/b of the fillet 50 formed on the pressure surface 30*a* may be different from a distribution of $R_S$/b of the fillet 50 formed on the suction surface 30*b*.

According to the findings of the present inventor, the thickness on the pressure surface 30*a* side of the boundary layer 91 of the diffuser passage 8 is different from that on the suction surface 30*b* side. Therefore, as described above, when the distribution of $R_P$/b of the fillet 50 formed in the pressure surface 30*a* is different from the distribution of $R_S$/b of the fillet 50 formed in the suction surface 30*b* depending on the thicknesses of the boundary layers 91 formed on the respective surfaces, it is possible to improve the diffuser performance.

When the fillet 50 is formed in each of the suction surface 30*b* and the pressure surface 30*a* of each of the plurality of diffuser vanes 30, the maximum value of $R_P$/b on the downstream side of the throat position 41*a* of the diffuser passage 8 may be larger than the maximum value of $R_S$/b on the downstream side of the throat position 41*a* of the diffuser passage 8.

According to the findings of the present inventor, at a certain operating point of the centrifugal compressor, the boundary layer 91 on the pressure surface 30*a* side is thicker than that on the suction surface 30*b* side. Therefore, as described above, when the maximum value of $R_P$/b on the pressure surface 30*a* side on the downstream side of the throat position 41*a* is larger than the maximum value of $R_S$/b on the suction surface 30*b* side, it is possible to improve the diffuser performance.

The fillet 50 may be formed in only the connection portion 43 between the hub-side surface 13*a* and each of the plurality of diffuser vanes 30 or in only the connection portion 45 between the shroud-side surface 15*a* and each of the plurality of diffuser vanes 30.

The fillet 50 formed in only the connection portion 43 between the hub-side surface 13*a* and each of the plurality of diffuser vanes 30 or in only the connection portion 45 between the shroud-side surface 15*a* and each of the plurality of diffuser vanes 30 contributes to improvement in the diffuser performance.

In some embodiments described above, the tips 21*a* of the plurality of vanes 21 are arranged with a predetermined gap with respect to the inner surface 3*a* of the casing 3 of the centrifugal compressor 100. Moreover, in some embodiments described above, the fillet 50 may be formed in at least the connection portion 45 between the shroud-side surface 15*a* and each of the plurality of diffuser vanes 30.

That is, in some embodiments described above, the impeller 20 is configured as a so-called open-type impeller that does not have an annular shroud member.

According to the findings of the present inventor, in the centrifugal compressor 100 having an open-type impeller, the boundary layer 91 which is thicker on the shroud-side surface 15*a* than that on the hub-side surface 13*a* is formed due to the influence of a leakage flow from the tip clearance of the vane 21.

Therefore, according to the embodiment described above, since the fillet 50 is formed in the connection portion 45 between the shroud-side surface 15*a* and each of the plurality of diffuser vanes 30, it is possible to achieve improvement in the diffuser performance of an open-type impeller.

In the embodiment described above, the impeller 20 may have an annular shroud member.

As described above, since the centrifugal compressor 100 according to some embodiments includes the vaned diffuser 10 according to the embodiment described above, it is possible to improve the diffuser performance effectively and improve the efficiency of the centrifugal compressor 100.

While the embodiment of the present invention has been described, the present invention is not limited to the above-described embodiments but includes modifications of the above-described embodiments and appropriate combinations of these modifications.

In some embodiments described above, although a centrifugal compressor has been described, the features of some embodiments described above can be applied to a centrifugal pump.

The invention claimed is:

1. A vaned diffuser provided on a downstream side of an impeller of a centrifugal compressor, comprising:

a diffuser passage forming portion that includes a hub-side surface and a shroud-side surface facing the hub-side surface and forms an annular diffuser passage on a downstream side of the impeller; and a plurality of diffuser vanes provided in the diffuser passage at intervals in a circumferential direction of the impeller, wherein a first fillet is formed on a pressure surface of each of the plurality of diffuser vanes in a connection portion which connects the pressure surface and at least one of the hub-side surface and the shroud-side surface, a second fillet is formed on a suction surface of each of the plurality of diffuser vanes in a connection portion which connects the suction surface and at least one of the hub-side surface and the shroud-side surface, wherein R is a radius of each fillet and b is a vane height of each of the plurality of diffuser vanes, and a maximum value of R/b on a downstream side of a throat position of the diffuser passage is larger than a maximum value of R/b on an upstream side of the throat position of the diffuser passage, and when $R_p$ is a radius of the first fillet formed on the pressure surface and $R_s$ is a radius of the second fillet formed on the suction surface, a distribution of $R_p$/b of the first fillet formed on the pressure surface is different from a distribution of $R_s$/b of the second fillet formed on the suction surface.

2. The vaned diffuser according to claim 1, wherein the maximum value of R/b on the downstream side of the throat position of the diffuser passage is equal to or more than 0.2.

3. The vaned diffuser according to claim 1, wherein

R/b in at least a partial segment on the downstream side of the throat position of the diffuser passage increases toward a trailing edge side of the diffuser vane.

4. The vaned diffuser according to claim 3, wherein

R/b in at least a partial segment on the downstream side of the throat position of the diffuser passage increases linearly toward the trailing edge side of the diffuser vane.

5. The vaned diffuser according to claim 1, wherein a maximum value of $R_P$/b on the downstream side of the throat position of the diffuser passage is larger than a maximum value of $R_S/b$ on the downstream side of the throat position of the diffuser passage.

6. The vaned diffuser according to claim 1, wherein the impeller includes a plurality blades provided at intervals in the circumferential direction of the impeller, tips of the plurality of blades are arranged with a predetermined gap with respect to an inner surface of a casing of the centrifugal compressor, the first fillet is formed at least in a connection portion which connects the shroud-side surface and the pressure surface of each of the plurality of diffuser vanes, and the second fillet is formed at least in a connection portion which connects the shroud-side surface and the suction surface of each of the plurality of diffuser vanes.

7. A centrifugal compressor comprising:

an impeller; and the vaned diffuser according to claim 1.

* * * * *